United States Patent [19]

Jalil

[11] Patent Number: 4,527,408

[45] Date of Patent: Jul. 9, 1985

[54] METHOD AND APPARATUS FOR COOLING AND HANDLING HOT ROLLED STEEL ROD IN DIRECT SEQUENCE WITH A HIGH SPEED ROLLING OPERATION

[75] Inventor: Asjed A. Jalil, Holden, Mass.

[73] Assignee: Morgan Construction Company, Worcester, Mass.

[21] Appl. No.: 547,087

[22] Filed: Oct. 31, 1983

[51] Int. Cl.[3] ..... B21B 45/02; C21D 9/52

[52] U.S. Cl. ..... 72/201; 148/12 B

[58] Field of Search ..... 72/128, 201; 148/12 B; 266/106, 113

[56] References Cited

U.S. PATENT DOCUMENTS

| | | | |
|---|---|---|---|
| 2,756,169 | 7/1956 | Corson et al. | 148/12.4 X |
| 3,479,853 | 11/1969 | Berry | 72/201 |
| 4,060,428 | 11/1977 | Wilson et al. | 148/12 B X |
| 4,168,993 | 9/1979 | Wilson et al. | 148/12 B |
| 4,222,257 | 9/1980 | Theis et al. | 72/201 |
| 4,388,816 | 6/1983 | Ferket et al. | 72/201 X |

FOREIGN PATENT DOCUMENTS

| | | | |
|---|---|---|---|
| 1071315 | 6/1967 | United Kingdom | 72/201 |

*Primary Examiner*—E. Michael Combs

*Attorney, Agent, or Firm*—Maurice E. Gauthier

[57] ABSTRACT

A method and apparatus for quenching steel rod in a high speed rolling mill is provided wherein a liquid coolant is preliminarily applied to the rod prior to its exiting from the mill finishing train in order to increase the column strength of the exiting rod by lowering the surface temperature thereof to less than about 950° C. Thereafter, as the rod progresses through additional liquid cooling devices on the way to the mill laying head, tractive forces are applied to the rod. The aforesaid increase in rod column strength acts in concert with the application of tractive force to insure that the rod has sufficient rigidity and forward momentum to pass from the finishing train through the liquid cooling devices and to and through the laying head.

10 Claims, 1 Drawing Figure

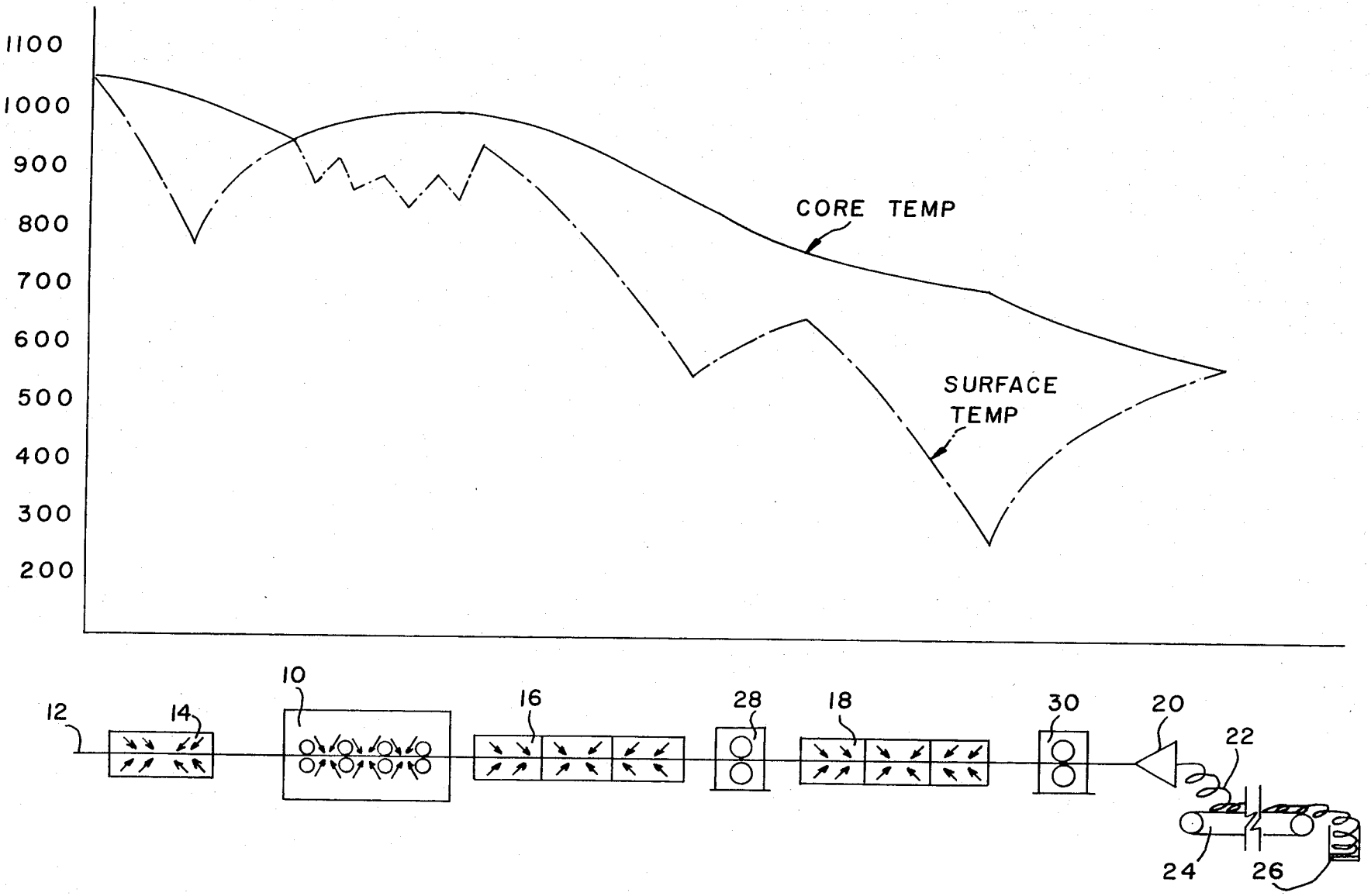
CORE TEMP
SURFACE TEMP
1100
1000
900
800
700
600
500
400
300
200
10
12
14
16
18
20
22
24
26
28
30

METHOD AND APPARATUS FOR COOLING AND HANDLING HOT ROLLED STEEL ROD IN DIRECT SEQUENCE WITH A HIGH SPEED ROLLING OPERATION

BACKGROUND OF THE INVENTION

This invention relates to the hot rolling and direct sequential cooling of steel rod. As herein employed, the term "rod" is used to designate a product ranging from about 4.0 to 8.0 mm. in diameter.

Conventionally, steel rod exits from the mill finishing train at temperatures of at least about 1038° C. The rod proceeds via delivery pipes directly from the mill finishing train through water boxes where it is cooled by a surface application of cooling water. Thereafter, the rod is directed to a laying head where it is formed into a succession of rings. The rings are normally deposited in an offset or Spencerian pattern on an open moving conveyor, where they are subjected to additional controlled cooling before finally being accumulated into coils.

Due to the relatively high temperatures at which the rod is finish rolled, it has very little if any column strength as it exits from the mill. In modern high speed mills, i.e., those having finishing speeds of at least about 75 m./sec., this severely limits the extent to which the rod can be cooled in the water boxes as it travels from the mill to the laying head. This limitation stems from the fact that there is a frictional resistance imposed on the rod by the cooling water. If this frictional resistance is allowed to exceed what little column strength the rod has, then the rod will collapse or "cobble". This problem becomes increasingly acute as rod diameters decrease and mill delivery speeds increase. Thus, in conventional high speed mills, depending on the size of the product being rolled and the mill delivery speed, the minimum temperatures to which rod cans safely be water cooled before being laid on the conveyors usually range from about 760° C. to 927° C.

As a further precautionary measure in avoiding cobbles, it has become customary in high speed mills not to begin water cooling the rod until after its front end has passed through the water boxes and the laying head and rings have begun to accumulate on the conveyor. The uncooled front section of the rod thus lacks the desired metallurgical structure which results at least in part from water cooling. The front section must, therefore, be scrapped. Such scrap loses can be considerable, in some cases amounting to as much as 0.6% of the mill's annual production.

Against this backdrop, there is now a growing interest in processes which involve subjecting hot rolled steel rod to a much more drastic water quench, thereby enabling the rod to be laid on the conveyor at temperatures well below 760° C. Among the objectives of such processes are the reduction of scale formation on the rod surface and the production of specific microstructures and mechanical properties. U.S. Pat. No. 3,926,689 discloses one such process where the product exiting from the mill is rapidly quenched to provide a surface layer of bainite or martensite which is then tempered by the heat transferred from the product core to its surface during subsequent cooling. In order to achieve this result, a rapid surface quenching is required down to about 300° C. Such processes have been employed successfully in bar mills, where products having diameters larger than about 14.0 mm. are rolled at slower delivery speeds below about 15 m/sec. Here, the frictional resistance imposed by accellerated water cooling is both lessened due to the lower speed of the product, and is safely offset by the greater inherent column strength of the larger diameter products. However, such processes have yet to be applied to modern high speed rod mills, where smaller diameter products exit from the mill at significantly higher mill delivery speeds.

SUMMARY OF THE PRESENT INVENTION

An object of the present invention is the provision of a method and apparatus for rapidly quenching rod produced by modern high speed rod mills so as to enable the rod to be laid on a cooling conveyor at temperatures below about 760° C.

A more specific object of the present invention is the provision of a method and apparatus for greatly increasing the amount of water which can be applied to, and hence the rate at which rod may be surface quenched as it exits from the mill finishing train of a high speed rod mill.

Another object of the present invention is to provide a method and apparatus for water quenching the entire length of the rod, including the front end section thereof.

These and other objects and advantages of the present invention are achieved in a preferred embodiment to be hereinafter described in more detail by preliminarily applying a liquid coolant e.g. water, to the rod prior to its exiting from the mill finishing train. This preliminary application of cooling water preferably takes place both prior to and during the passage of the rod through the mill finishing train, and in amounts sufficient to increase the column strength of the rod exiting from the finishing train by lowering the surface temperature thereof to less than about 950° C. Thereafter, a tractive force is applied to the rod at at least one location between the finishing train and the laying head. Preferably, the tractive force is generated by passing the rod through the nip of at least one set of driven pinch rolls. Preferably, water cooling boxes are arranged both in advance of and following the pinch rolls. These water cooling boxes have the capacity to further quench the rod to below 760° C. before it is laid on the conveyor.

The number of applications of tractive force will vary depending on the distance that the rod must travel from the finishing train to the laying head, as well as on the type of product being rolled, the mill delivery speed, and the extent to which the rod must be water quenched.

It is expected that the increase in column strength resulting from preliminarily water cooling the rod before it exits from the mill finishing train will enable the entire length of the rod, including its front end, to be water cooled as it travels through the water boxes located both in advance of and following the pinch rolls. The tractive force of the pinch rolls will insure that the rod has sufficient forward momentum to continue to and through the laying head.

BRIEF DESCRIPTION OF THE DRAWING

The single FIGURE is a graph illustrating the surface and core temperatures of a rod being processed in a high speed rod mill in accordance with the present invention, with the mill components being shown diagrammatically along the horizontal axis of the graph, and with the vertical axis of the graph being incrementally subdivided in °C.;

DETAILED DESCRIPTION OF ILLUSTRATIVE EMBODIMENT

It will be understood that the apparatus components in the illustrative embodiment are well known to those skilled in the art. Consequently, they have been shown in diagrammatic form, since the invention resides not in the specific form of the individual apparatus components, but rather in their combination and the method or process of operating that combination.

Referring now to the drawing, a rod mill finishing train 10 is shown positioned along the mill rolling line 12 downstream of a conventional intermediate train (not shown). Although the successive work roll pairs of the finishing train have been illustrated horizontally, those skilled in the art will appreciate that in actual practice, the roll axes of successive roll pairs will be offset by 90° so as to eliminate any twisting of the product as it progresses through the finishing train. A typical finishing train of this type is shown, for example, in U.S. Pat. No. RE 28,107.

In accordance with the present invention, the finishing train 10 has been modified to incorporate water cooling nozzles between the successive roll pairs. As schematically depicted by the arrows in the drawing, these nozzles apply high pressure water to the surface of the product as it passes through the finishing train.

The finishing train 10 is preceded by a water box 14 which also can be of conventional design, having a succession of water nozzles through which the product is directed after leaving the last roll stand of the preceding intermediate train. Again, as schematically depicted by the arrows in the drawing, the water nozzles of cooling box 14 apply cooling water to the surface of the product passing therethrough.

Additional water boxes 16, 18 are located between the finishing train 10 and a laying head 20, with their application of cooling water also being schematically depicted by arrows. The laying head forms the product into a succession of rings 22 which are received in an offset pattern on an open moving conveyor 24. A reforming tub 26 at the delivery end of the conveyor receives the offset rings and gathers them into coils. In the illustrated embodiment, a driven pinch roll unit 28 is located between the water boxes 16 and 18, and another driven pinch roll unit 30 is located between the water box 18 and the laying head 20.

The operation of the foregoing installation will now be described with reference to the finish rolling of 6.0 mm diameter carbon steel rod at a mill delivery speed of 85 m./sec., with immediate in-line quenching to produce a tempered martensite surface layer with a core consisting of pro-eutectoid ferrite and pearlite.

As the product enters the water box 14, it has a diameter of approximately 18 mm, a surface temperature on the order of 1050° C., and it is travelling at a speed of about 9 m./sec. The water nozzles of the water box 14 operate to quench the surface temperature of the product down to about 800° C., with an accompanying lowering of the core temperature down to about 1000° C. Thereafter, the surface and core temperatures are allowed to equalize rapidly to about 950° C. before the product enters the finishing train 10.

As the product progresses through the roll passes of the finishing train, it experiences successive elongations accompanied by reductions in cross-sectional area. During this finish rolling, the water cooling nozzles between the successive roll pairs of the finishing train operate to intermittently lower the surface temperature of the product by increments averaging about 50° C. However, because of the energy being imparted to the product during finish rolling, the surface temperature again rises after each intermittent application of cooling water with the net result being that as the rod emerges from the finishing train, its surface temperature is about 850° C., and its core temperature is about 1000° C.

If the same rod were to be processed without water cooling prior to and during finish rolling, it would exit from the finishing train 10 with a surface temperature of about 1070° C. and a core temperature of about 1100° C. At such elevated temperatures, the rod would have little if any column strength, thus making it impossible to do any water quenching until after the rod front end had passed through the laying head 20 and had begun to accumulate in ring form on the conveyor 24. In contrast, by finish rolling at lower surface and core temperatures in accordance with the present invention, the column strength of the exiting rod is increased significantly. As of this writing, the extent of this increase has yet to be quantified. Conservative estimates indicate, however, that the resulting increase in column strength will be more than enough to offset the frictional resistance encountered by the product as it passes through the water box 16 on its way to the first pinch roll unit 28. For at least some rod products, it is expected that the resulting increase in column strength will enable the entire rod length, including its front end section, to be quenched in the water box 16.

The quenching action of the water nozzles in water box 16 will further reduce the temperature of the rod surface to about 550° C., and the temperature of the rod core to about 850° C. These temperature reductions will be accompanied by a further increase in column strength.

The driven rolls of the pinch roll unit 28 will then grip and exert a tractive force on the rod thereby propelling the rod forwardly through the next water box 18. Here again, the additional increase in column strength resulting from the quenching action of the nozzles in water box 16 remains to be quantified. However, conservative estimates indicate that the rod will have enough column strength to safely continue through the water box 18 to the next pinch roll unit 30. For at least some rod products, it is expected that it will be possible to again quench the entire rod length, including its front end section, in the water box 18. As the rod emerges from water box 18, its surface temperature will have been quenched to about 270° C., and its core temperature will be about 700° C.

The driven rolls of the pinch roll unit 30 will then exert a second tractive force on the rod, thereby propelling the rod to and through the laying head 20. As the rod reaches the conveyor, its surface and core temperatures will have substantially equalized to about 570° C. Thereafter, the rod will continue cooling in offset ring form on the conveyor down to a mean temperature of about 400° C., at which point the offset rings will be reformed into upstanding cylindrical coils.

In light of the foregoing, it will now be appreciated by those skilled in the art that the present invention makes it possible to drastically quench rod exiting from modern high speed mills, in a manner and to an extent not heretofore possible with conventional technology. This result is achieved by water quenching the rod prior to its exiting from the mill finishing train in order to increase the rod's column strength, and by thereafter applying tractive forces to the thus strengthened rod in order to propel it through additional water quenching devices and the mill laying head. The increased rod column strength acts in concert with the application of tractive forces to insure that the rod has adequate rigidity and forward momentum to overcome any encountered frictional resistance.

I claim:

1. In a method of rolling steel rod in a rolling mill wherein said steel rod ranging from about 4.0 to 8.0 mm. in diameter exits from a mill finishing train at mill delivery speeds of at least about 75 m./sec., and the thus rolled rod is directed at said mill delivery speeds through liquid cooling devices to a laying head which forms the rod into rings, the improvement comprising:

(a) preliminarily applying liquid coolant to the rod prior to its exiting from the mill finishing train, the said preliminary application being sufficient to lower the surface temperature of the rod exiting from the mill finishing train to less than about 950° C. with an accompanying increase in the column strength thereof;

(b) operating said liquid cooling devices to lower the surface temperature of the rod to below 400° C. before the rod arrives at the laying head; and (c) applying a tractive force to the rod at at least one location between the mill finishing train and the laying head, the increase in rod column strength resulting from the aforesaid preliminary application of liquid coolant acting in concert with the said application of tractive force to insure that the rod has sufficient rigidity and forward momentum to pass from the finishing train through the liquid cooling devices and to and through the laying head.

2. The method of claim 1 wherein said preliminary application of liquid coolant occurs both prior to and during the passage of the rod through the mill finishing train.

3. The method of claim 1 wherein said tractive force is applied by passing the rod through the nip of at least one set of driven pinch rolls.

4. The method of any one of claims 1, 2 or 3 wherein the rod is passed through liquid cooling devices located both in advance of and following the application thereto of said tractive force, and wherein the liquid cooling devices located in advance of said application of tractive force are operated to cool the entire length of the rod.

5. The method of claim 4 wherein the liquid cooling devices following said application of tractive force also are operated to cool the entire length of the rod.

6. In a rolling mill wherein steel rod ranging from about 4.0 to 8.0 mm. in diameter exits from said mill finishing train at mill delivery speeds of at least about 75 m./sec., and the thus rolled rod is directed at said mill delivery speeds to a laying head which forms the rod into rings, the improvement comprising:

(a) first means for preliminarily applying liquid coolant to the rod prior to its exiting from the mill finishing train, the said preliminary application being sufficient to increase the column strength of the rod exiting from the mill finishing train by lowering the surface temperature thereof to less than about 950° C.;

(b) second means located between the mill finishing train and the laying head for applying liquid coolant to the rod in quantities sufficient to lower the surface temperature thereof to below 400° C. before the rod reaches the laying head; and (c) means for applying a tractive force to said rod at at least one location between the mill finishing train and the laying head, the increase in rod column strength resulting from the aforesaid preliminary application of liquid coolant acting in concert with the said application of tractive force to insure that the rod has sufficient rigidity and forward momentum to pass from the finishing train through the second liquid cooling means and to and through the laying head.

7. The apparatus of claim 6 wherein said first means for preliminarily applying liquid coolant is arranged in advance of the mill finishing train as well as between successive pairs of work rolls within the finishing train.

8. The apparatus of claim 6 wherein said means for applying a tractive force comprises least one set of driven pinch rolls.

9. The apparatus of any one of claims 6, 7 or 8 wherein said second liquid cooling means includes components located both in advance of and following said means for applying a tractive force, and wherein the components located in advance of said means for applying a tractive force operate to cool the entire length of the rod.

10. The apparatus of claim 9 wherein the components following said means for applying a tractive force also operate to cool the entire length of the rod.

* * * * *